US009888751B2

(12) United States Patent
Nagelberg

(10) Patent No.: US 9,888,751 B2
(45) Date of Patent: Feb. 13, 2018

(54) UMBRELLA

(71) Applicant: Justin Nagelberg, Del Mar, CA (US)

(72) Inventor: Justin Nagelberg, Del Mar, CA (US)

( * ) Notice: Subject to any disclaimer, the term of this patent is extended or adjusted under 35 U.S.C. 154(b) by 0 days.

(21) Appl. No.: 15/200,306

(22) Filed: Jul. 1, 2016

(65) Prior Publication Data

US 2018/0000211 A1 Jan. 4, 2018

(51) Int. Cl.
*A45B 25/14* (2006.01)
*A45B 25/16* (2006.01)
*A45B 25/08* (2006.01)

(52) U.S. Cl.
CPC ..... *A45B 25/143* (2013.01); *A45B 25/08* (2013.01); *A45B 25/16* (2013.01); *A45B 2200/1081* (2013.01)

(58) Field of Classification Search
CPC ..... A45B 19/00; A45B 25/143; A45B 25/08; A45B 25/16; A45B 2200/1081
USPC ..... 135/28, 24, 43
See application file for complete search history.

(56) References Cited

U.S. PATENT DOCUMENTS 167,070 A * 8/1875 Colby et al. ..... A45B 21/00 135/17
594,135 A * 11/1897 Hall ..... A45B 25/143 135/22
686,347 A * 11/1901 Scoenberg et al. .. A45B 25/143 135/22
2,405,044 A * 7/1946 Montalvo ..... A45B 25/12 135/44
4,934,394 A * 6/1990 Hermanson ..... A45B 19/00 135/19.5
5,036,782 A 8/1991 Huang
5,150,728 A 9/1992 Stark
5,247,955 A * 9/1993 Wu ..... A45B 25/143 135/22
6,273,111 B1 8/2001 Weiss et al.
7,588,041 B2 * 9/2009 Huang ..... A45B 25/16 135/24
8,469,044 B1 6/2013 Patel
(Continued)

FOREIGN PATENT DOCUMENTS

GB 802489 A * 10/1958 ..... A45B 25/006

OTHER PUBLICATIONS

Nagelberg, J, et al., "The Umbrella Reimagined," 2014, pp. 1-19, Kickstarter.

(Continued)

*Primary Examiner* — Noah C. Hawk
(74) *Attorney, Agent, or Firm* — RatnerPrestia

(57) ABSTRACT

An umbrella includes (a) a rod assembly including a plurality of rods; (b) a canopy connected to the rod assembly and movable between an open position in which the canopy is deployed and a closed position in which the canopy is retracted; (c) a stationary handgrip connected to the rod assembly for grasping the umbrella; (d) a trigger assembly that is releasably connected to at least one rod of the rod assembly, wherein, upon actuation of the trigger assembly, the trigger releases the at least one rod of the rod assembly which deploys and causes the canopy to move from the closed position to the open position; and (e) a handle movable with respect to the handgrip and connected to the rod assembly, the handle being translatable to move the canopy from the open position to the closed position.

16 Claims, 13 Drawing Sheets

(56) References Cited

U.S. PATENT DOCUMENTS

| | | | | |
|---|---|---|---|---|
| 9,486,044 | B1 * | 11/2016 | Dai | A45B 25/22 |
| 2003/0019514 | A1 | 1/2003 | Usui et al. | |
| 2009/0007946 | A1 | 1/2009 | Hsieh et al. | |
| 2009/0205693 | A1 | 8/2009 | Huang | |
| 2011/0132417 | A1 | 6/2011 | Lee | |
| 2012/0211040 | A1 | 8/2012 | Amalric et al. | |

OTHER PUBLICATIONS

International Search Report and Written Opinion for International Application No. PCT/US2017/037188, dated Oct. 24, 2017, 12 pages.

* cited by examiner

UMBRELLA

FIELD OF THE INVENTION

This disclosure relates to the field of umbrellas.

BACKGROUND OF THE INVENTION

Many conventional automatic umbrellas are operated by releasing a tensioned lock, button or trigger to automatically deploy a canopy of the umbrella from a closed position to an open position, and then downwardly pulling on a ring, which slides along a shaft of the umbrella, to return the canopy to the closed position. Described herein is a new and different design for opening and closing an umbrella.

SUMMARY OF THE INVENTION

Aspects of the invention relate to an umbrella.

In accordance with one aspect, the invention provides an umbrella comprising: (a) a rod assembly including a plurality of rods; (b) a canopy connected to the rod assembly and movable between an open position in which the canopy is deployed and a closed position in which the canopy is retracted; (c) a stationary handgrip connected to the rod assembly for grasping the umbrella; (d) a trigger that is configured to cause the canopy to move from the closed position to the open position, and (e) a handle movable with respect to the handgrip and connected to the rod assembly, the handle being translatable to move the canopy from the open position to the closed position.

In accordance with another aspect, the invention provides an umbrella comprising: (a) a rod assembly including a plurality of rods; (b) a canopy connected to the rod assembly and movable between an open position in which the canopy is deployed and a closed position in which the canopy is retracted; (c) a stationary handgrip for grasping the umbrella that is connected to said rod assembly; (d) a compression spring that is located within the handgrip and is biased to deploy at least one rod of the rod assembly and move the canopy toward the open position; (e) a trigger assembly that is releasably connected to said at least one rod of the rod assembly, wherein, upon actuation of the trigger assembly, the trigger releases said at least one rod of the rod assembly which deploys and causes the canopy to move from the closed position to the open position; (f) a handle movable with respect to said handgrip and connected to said rod assembly, the handle being translatable from a retracted position to an extended position to move the canopy from the open position to the closed position; and (g) a tension spring that is positioned to move the handle from the extended position back to the retracted position after the canopy is closed.

BRIEF DESCRIPTION OF THE DRAWINGS

The invention is best understood from the following detailed description when read in connection with reference to the accompanying drawings. According to common practice, the various features of the drawings are not drawn to scale unless otherwise indicated. On the contrary, the dimensions of the various features may be expanded or reduced for clarity. Included in the drawings are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and the range of equivalents of the claims without departing from the invention.

As used herein, "proximal" and "distal" refer to either a position or a direction relative to the free end of handle 20/220. For example, a proximal portion of a particular component is a portion nearer handle 20/220, and a distal portion is a portion further from handle 20/220. Furthermore, a proximal direction is a direction toward handle 20/220 and a distal direction is a direction away from handle 20/220.

FIGS. 1A-1F depict views of an umbrella 10, according to one example of the invention, shown moving between closed, open and late closing stages. Umbrella 10 is movable between the fully-closed and fully-open states shown in FIGS. 1A and 1C, respectively. Umbrella 10 generally includes a stationary handgrip 11 connected to a deployable canopy 12 by a rod assembly 13. Rod assembly 13 includes mechanisms for deploying and retracting canopy 12 between the opened and closed states.

Figure 1A:
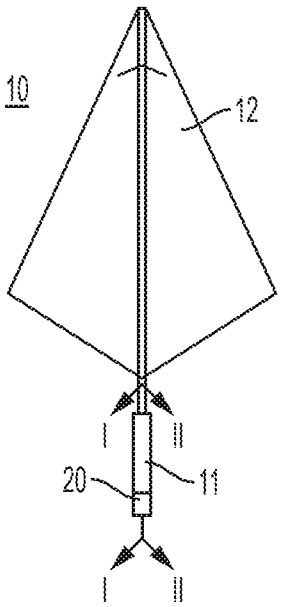
FIG. 1A depicts an elevation view of an umbrella shown in a fully-closed state, according to one example of the invention.
Figure 2:
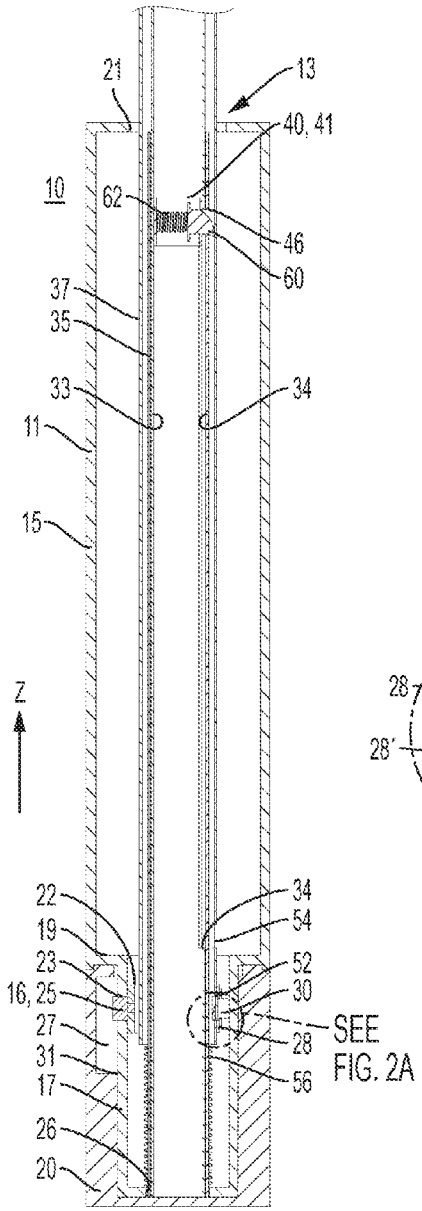
FIGS. 2 and 3 are cross-sectional views of the umbrella of FIG. 1A taken along the lines I-I and II-II, respectively.
Figure 3:
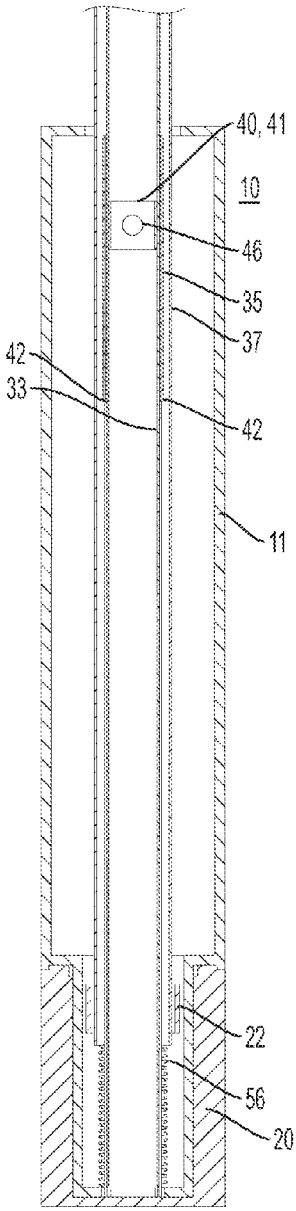

Referring now to FIGS. 1A, 2 and 3, handgrip 11 includes a large diameter distal portion 15 to be grasped by a user of umbrella 10 and a small diameter proximal portion 17, each of which is substantially tubular in shape and includes a hollow interior region. A shoulder 19 is formed at the interface between distal portion 15 and proximal portion 17 for bearing upon the distal end of movable handle 20 in the fully-closed and fully-open positions of umbrella 10. Proximal portion 17 is sized to fit within the hollow interior of a movable handle 20. The revolved exterior surface of distal portion 15 may include a surface texture for enhanced dexterity.

The hollow interior region of handgrip 11 is sized to accommodate a portion of rod assembly 13. The top distal end of distal portion 15 includes an aperture 21 through which at least two rods of rod assembly 13 extend. The lower proximal end of proximal portion 17 also includes an aperture 26 through which two rods of rod assembly 13 are at least partially positioned. Another aperture 23 is provided on the side surface of proximal portion 17 through which a spring-loaded trigger assembly 16 is moveably positioned.

Figure 1B:
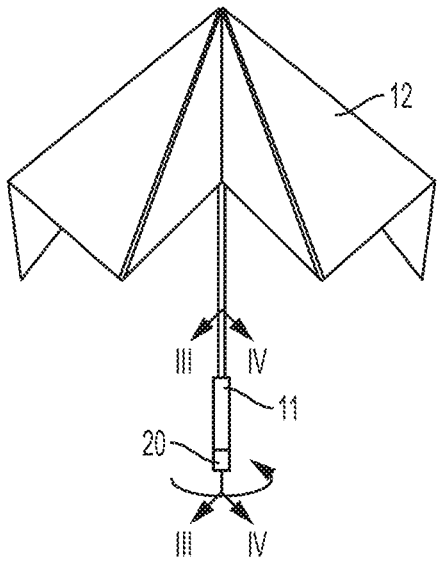
FIG. 1B depicts an elevation view of the umbrella of FIG. 1A shown in a mid-opened state.

Spring-loaded trigger assembly 16 may be considered as forming part of handgrip 11 because it is mounted to handgrip 11. Spring-loaded trigger assembly 16 generally includes a circular ring 22 surrounding rod assembly 13. A cylindrical trigger 25 is fixed to ring 22 and is positioned to extend outwardly in a radial direction from the exterior surface of ring 22. Trigger 25 may be a separate component, such as a pin, that is mounted to ring 22 or trigger 25 may be integral with ring 22. A hook 28 (see FIG. 3) is fixed to ring 22 and is positioned to extend inwardly in a radial direction from the interior surface of ring 22. As best shown in FIG. 2A, hook 28 includes a flat lower surface 28' that intersects a curved outer surface. The curved outer surface of hook 28 extends along the length of ring 22 and increases in depth toward the bottom end of ring 22. The flat lower surface 28' of hook 28, which acts as a catch, is formed at the lower proximal end of ring 22. Hook 28 and trigger 25 are positioned on opposing sides of ring 22. A compression spring 30 is fixed to the exterior surface of ring 22, and is located directly opposite hook 28. Spring 30 biases trigger assembly 16 to the left, as taken from the view shown in FIG. 1. More particularly, spring 30 biases hook 28 toward rod assembly 13, the purpose of which will be described in greater detail later. Spring 30 is sandwiched between the outer surface of ring 22 and the interior surface of proximal portion 17 of handgrip 11. Spring 30 may also be additionally or alternatively fixed to the interior surface of proximal portion 17 of handgrip 11, if so desired.

Moveable handle 20 is substantially tubular in shape and includes a hollow interior region for accommodating proximal portion 17 of handgrip 11. The revolved exterior surface of handle 20 may include a surface texture for enhanced dexterity. The outer diameter of handle 20 is substantially equal to the outer diameter of distal portion 15 of handgrip to provide a seamless transition along the length of portion 15 and handle 20.

Figure 6:
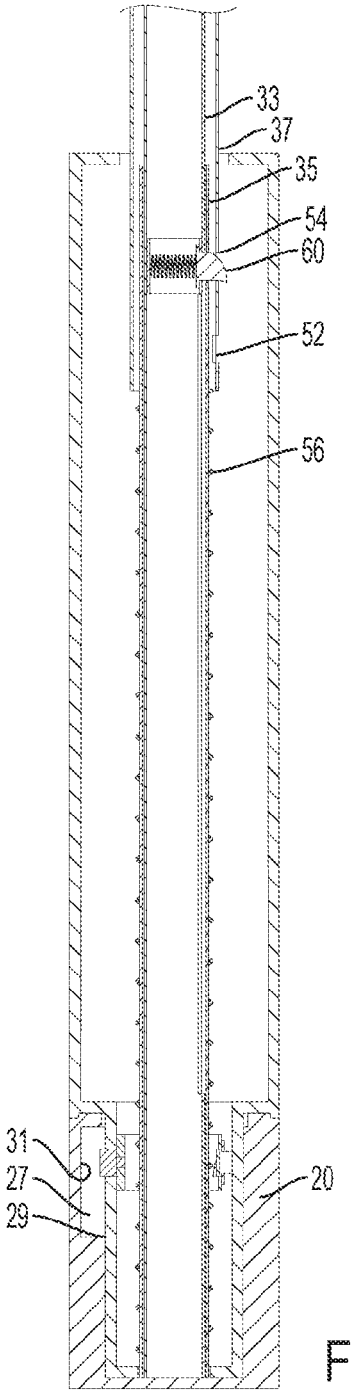
FIGS. 6 and 7 are cross-sectional views of the umbrella of FIG. 1C taken along the lines V-V and VI-VI, respectively.
Figure 14:
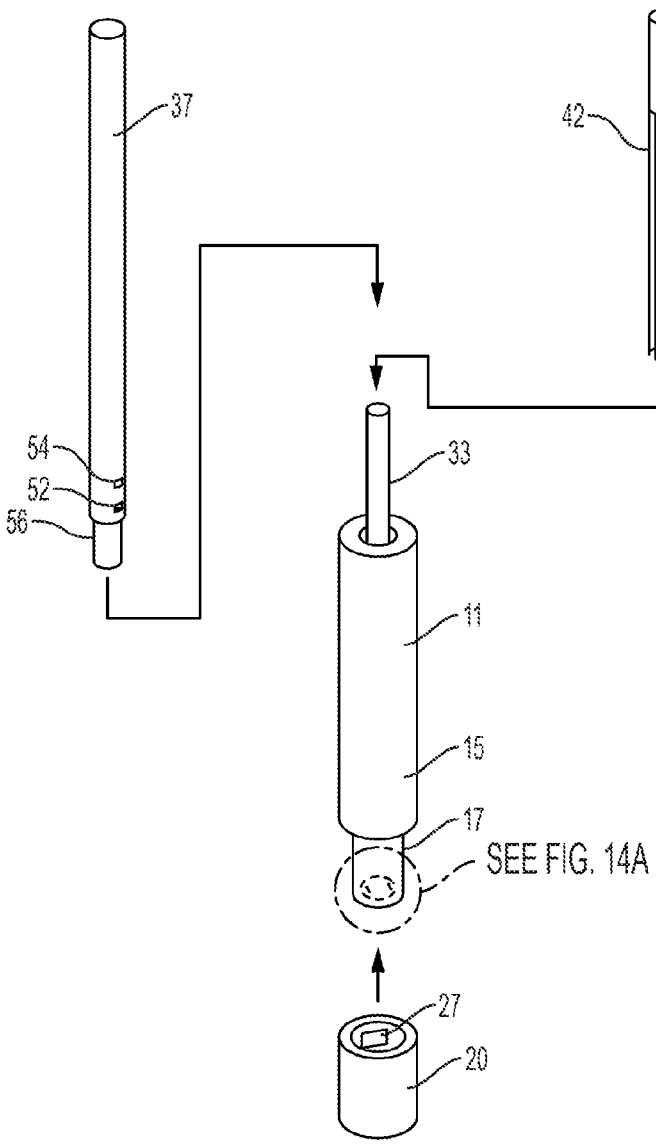
FIG. 14 is a partially exploded view of the umbrella base of FIGS. 1A-1F and including a detailed view of the handgrip.
Figure 14A:
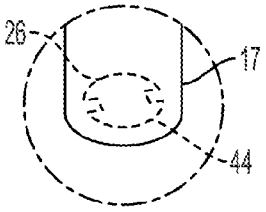
FIG. 14A is a detailed view of FIG. 14.

A ramp surface 27 is defined on the interior surface of handle 20 for engaging spring-loaded trigger assembly 16, the purpose of which will be described later. As best shown in FIGS. 6 and 14, ramp surface 27 transitions from the regular inner diameter 29 of handle 20 to an enlarged inner diameter 31. Ramp surface 27 extends only partially along the inner circumference of handle 20, i.e., by about 30 degrees, for example, as viewed from the top end of handle 20. In operation, handle 20 is capable of translating in two opposite directions along Z-axis shown in FIG. 3, and rotating about the Z-axis in two opposite rotational directions. Ramp surface 27 is configured to interact with spring-loaded trigger assembly 16 to accomplish the deployment function of umbrella 10, which will be described in greater detail later.

Although not shown, and in an alternative embodiment of umbrella 10, handle 20 may not be configured to rotate, and ramp surface 27 may be omitted. In this alternative embodiment, handle 20 would include an aperture through which trigger 25 extends to the outside of handle 20, thereby enabling a user of umbrella 10 to directly actuate trigger 25 of spring-loaded trigger assembly 16.

Referring still to FIGS. 1A, 2 and 3, telescoping rod assembly 13 generally includes three telescoping hollow rods, i.e., an inner rod 33, a central rod 35 surrounding inner rod 33, and an outer rod 37 surrounding central rod 35; in addition to an upper spring loaded hook assembly 40 that is configured to interact with all three rods of rod assembly 13 for controlling the telescoping motion of rod assembly 13.

Figure 7:
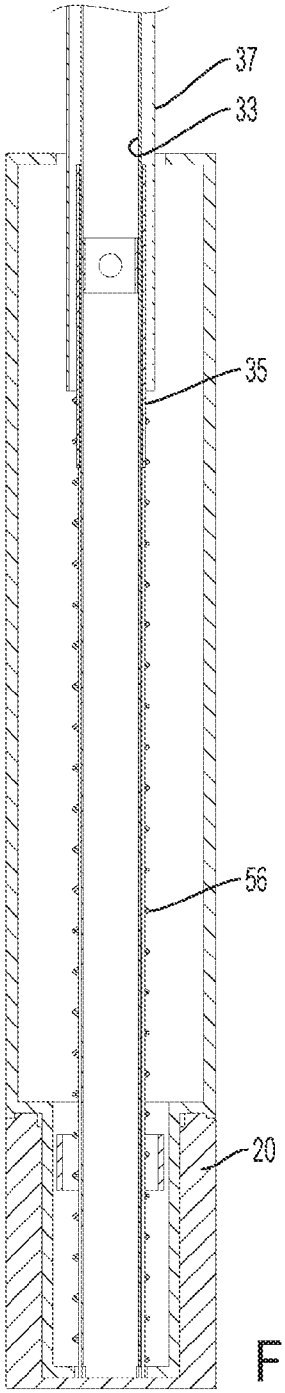

Inner rod 33 includes a proximal end that is fixedly mounted to aperture 26 formed in the bottom end of proximal portion 17 of handgrip 11. Inner rod 33 extends to the top end of umbrella 10 and the top distal end of inner rod 33 is connected to the arms of canopy 12, as shown in FIG. 14. Inner rod 33 includes an elongated slot 34 (see FIGS. 1 and 7) along which upper spring loaded hook assembly 40 translates in operation. Elongated slot 34 extends along axis Z and along a portion of the length of inner rod 33. Inner rod 33 does not translate in operation, rather the other rods 35 and 37 and upper spring loaded hook assembly 40 translate with respect to inner rod 33 and handgrip 11.

Figure 8:
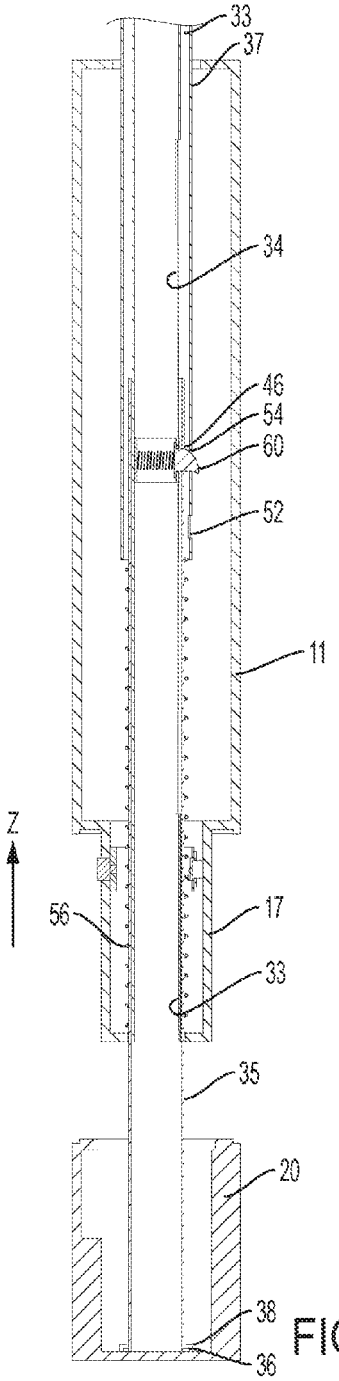
FIGS. 8 and 9 are cross-sectional views of the umbrella of FIG. 1D taken along the lines VII-VII and VIII-VIII, respectively.
Figure 9:
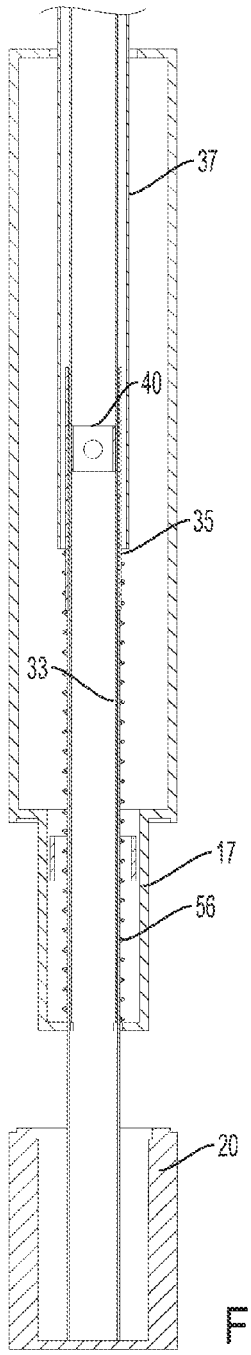
Figure 10:
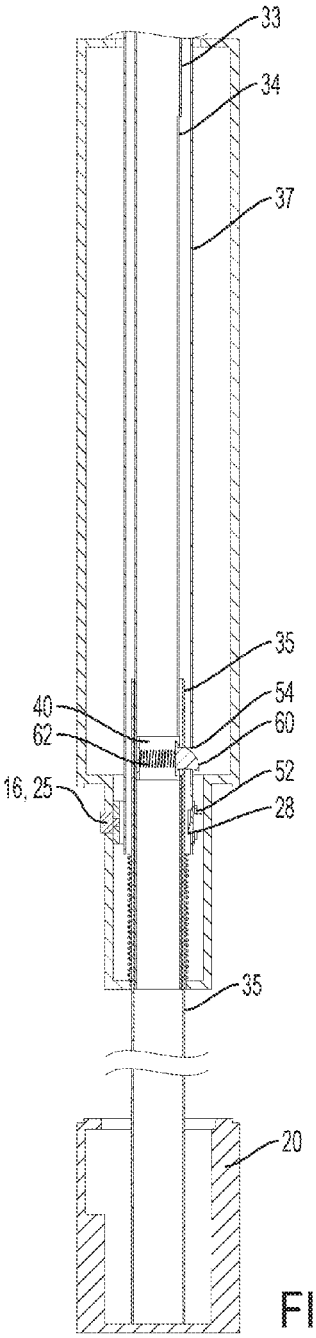
FIGS. 10 and 11 are cross-sectional views of the umbrella of FIG. 1E taken along the lines IX-IX and X-X, respectively.
Figure 11:
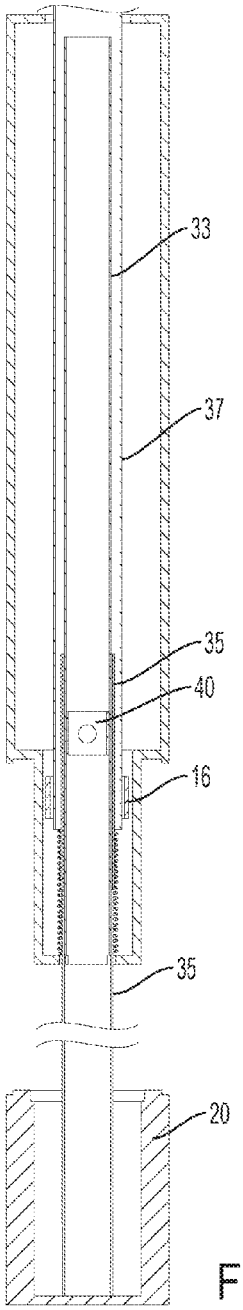

Central rod 35, which surrounds inner rod 33, includes a base end that is connected to the lower interior surface of handle 20. As shown in FIG. 8 (only), the proximal end 36 of rod 35 is flared outwards and is captivated within fingers 38 extending upward from the lower interior surface of handle 20. By virtue of the connection between end 36 and fingers 38, handle 20 is configured to rotate about the Z-axis with respect to central rod 35 (central rod 35 is unrotatable), and central rod 35 is capable of translating along the Z-axis along with handle 20. Those skilled in the art will recognize that other means exist for connecting handle 20 and rod 35 such that handle 20 can rotate about rod 35 and translate with rod 35. The top distal end of central rod 35, which is free and disconnected, is substantially positioned within the interior of handgrip 11 in both the closed and opened states of umbrella 10.

As best shown in FIGS. 2, 3 and 14, central rod 35 includes two elongated and open-ended slots 42 each of which extends through the bottom end of central rod 35. Slots 42 are positioned on opposite diametric sides of rod 35. In assembled form of umbrella 10, slots 42 are positioned within tabs 44 (see FIG. 14) that extend inwardly from lower aperture 26 of handgrip 11. Engagement between slots 42 and tabs 44 controls motion of central rod 35 as it translates along handgrip 11 and prevents relative rotation between central rod 35 and handgrip 11. Central rod 35 also includes an aperture 46 near its top end for interacting with upper spring loaded hook assembly 40. Aperture 46 is positioned diametrically between slots 42 and is sized to receive hook assembly 40.

Outer rod 37, which surrounds central rod 35, includes a proximal lower end positioned within handgrip 11 and a distal top end that is fixedly connected to a hinged arm assembly 50 (see FIG. 15) such that central rod 35 and hinged arm assembly 50 move together.

A lower aperture 52 is disposed through the sidewall of outer rod 37 at a location near the proximal end of outer rod 37. Lower aperture 52 is sized to receive triangular hook 28 of spring-loaded trigger assembly 16 in a closed position of umbrella 10, as shown in FIG. 3. An upper aperture 54 is also disposed through the sidewall of outer rod 37 at a location directly above lower aperture 52. Upper aperture 54 is sized to receive hook 60 of upper spring loaded hook assembly 40 in the open and partially-open states of umbrella 10, as shown in FIGS. 6 and 8.

A compression spring 56 is positioned between the proximal end of outer rod 37 and lower aperture 26 of handgrip 11 to bias outer rod 37 in an upward direction and away from aperture 26 and handle 20. Compression spring 56 may be fixed to the proximal end of outer rod 37 by a weld, for example. Alternatively, spring 56 may simply bear upon the proximal end of outer rod 37. Although not shown, a flange (not shown) or other surface may be formed on the proximal end of outer rod 37 upon which spring 56 bears.

Figure 4:
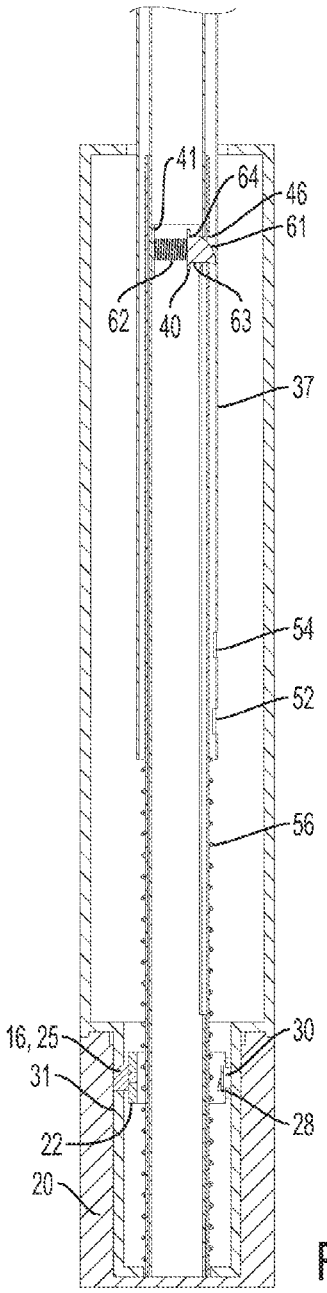
FIGS. 4 and 5 are cross-sectional views of the umbrella of FIG. 1B taken along the lines III-III and IV-IV, respectively.

Upper spring-loaded hook assembly 40 generally includes a circular ring 41 positioned within the interior of inner rod 33. A spring-loaded hook 60 is positioned at least partially within ring 41. Hook 60 includes a flat lower surface that intersects a curved outer surface. As shown in FIG. 4, hook 60 includes a flange 64 that is formed on its interior facing surface. Flange 64 is configured to retain hook 60 at least partially within the boundary of ring 41 during operation of umbrella 10. A curved outer surface 61 extends outwardly from flange 64, and curved outer surface 61 terminates at a planar surface 63 that extends in a radial direction. Hook 60 is sized to selectively engage with the interior side wall of outer rod 37, aperture 46 of central rod 35, aperture 54 of outer rod 37, and elongated slot 34 of inner rod 33, as shown throughout the figures. A compression spring 62 is sandwiched between the interior surface of ring 41 and the interior facing surface of hook 60 to bias hook 60 outwardly in a radial direction. Spring 62 may be fixed to ring 41 and/or hook 60 by a weld, for example. In operation, the axial position of hook assembly 40 shifts within the interior of handgrip 11, as will be described later.

Figure 15:
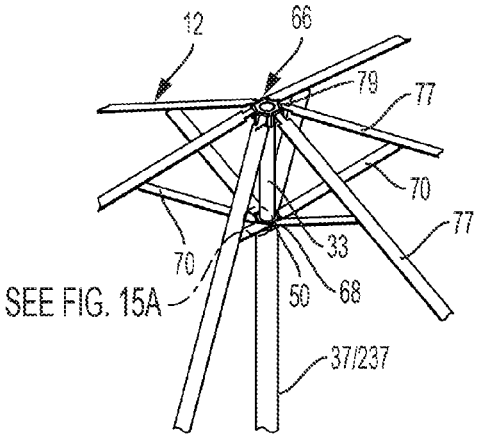
FIGS. 15, 16 and 17 are isometric views of the top end of the umbrella of FIGS. 1A-1F, with various components omitted, in a fully-open state, a mid-open/closed state and a fully-closed state, respectively.
Figure 16:
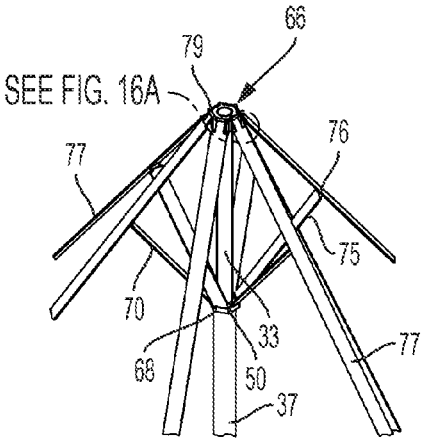
Figure 17:
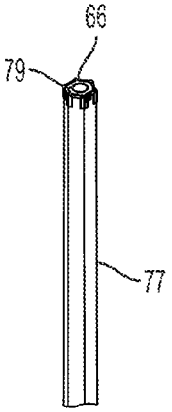

FIGS. 15-17 depict the distal end of umbrella 10 including the distal end of telescoping rod assembly 13, hinged arm assembly 50, canopy arm assembly 66 and canopy 12. Although not shown in FIGS. 15-17, it should be understood that the fabric canopy 12 is fixedly mounted to each arm 77 of canopy arm assembly 66 (either directly or indirectly) such that the fabric canopy 12 moves with arms 77. The material of canopy 12 may vary.

Hinged arm assembly 50 includes a ring connector 68 that is fixed to the top distal end of outer rod 37. Ring connector 68 includes a central hole through which inner rod 33 translates up and down. The outer surface of ring connector 68 is substantially hexagonal. Those skilled in the art will recognize that the outer surface of the ring connector 68 may take any another polygonal shape. A plurality of arms 70 (six shown) are pivotably and hingedly connected to ring connector 68. The proximal ends of arms 70 are interconnected by a web of material 73 such that the arms 70 pivot together in unison. Alternatively, the proximal ends of arms 70 may be separated from each other. The number of arms 70 may vary.

Figure 15A:
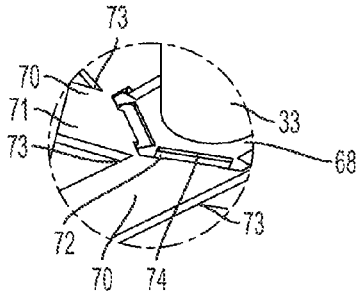
FIGS. 15A and 16A are detailed views of FIGS. 15 and 16, respectively.

As best shown in FIG. 15A, the proximal end 71 of each arm 70 includes a cylindrical hinge element 72. Each hinge element 72 is pivotably connected to a respective semi-cylindrical recess 74 formed on the surfaces of the hexagon of ring connector 68. The connection between hinge element 72 and recess 74 may be a snap-fit, for example. Alternatively, hinge element 72 may be connected to ring connector 68 by a pin (not shown) or any other device known to those skilled in the art that would permit arm 70 to pivot with respect to ring connector 68.

The distal end 75 of each arm 70 includes a cylindrical hinge element 76. Each hinge element 76 is pivotably and hingedly connected to a respective arm 77 of canopy arm assembly 66. The connection between each hinge element 76 and its respective arm 77 may be snap-fit, pinned, press-fit, or any other device known to those skilled in the art that would permit arm 70 to pivot with respect to arm 77.

Canopy arm assembly 66 includes a ring connector 79 that is fixed to the top distal end of inner rod 33. The outer surface of ring connector 79 is substantially hexagonal. Those skilled in the art will recognize that the outer surface of the ring connector 79 may take any another polygonal shape. A plurality of arms 77 (six shown) are pivotably and hingedly connected to ring connector 79. The number of arms 77 may vary.

Alternatively, the arms 77 may be omitted in favor of attaching the arms 70 directly to the canopy 12. In such an embodiment, the tension between the canopy panels would assist in opening and closing the canopy 12 of the umbrella 10 like an origami figure (as well as umbrella 200 described later).

Figure 16A:
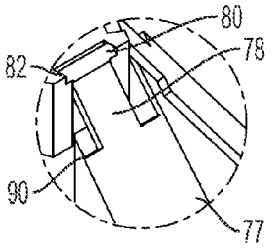

As best shown in FIG. 16A, the distal end 78 of each arm 77 includes a cylindrical hinge element 80. Each hinge element 80 is pivotably connected to a respective semi-cylindrical recess 82 formed on the surfaces of the hexagon of ring connector 79. The connection between hinge element 80 and recess 82 may be a snap-fit, for example. Alternatively, hinge element 80 may be connected to ring connector 79 by a pin (not shown) or any other device known to those skilled in the art that would permit arm 77 to pivot with respect to ring connector 79. Cutouts 90 are formed on each surface of the hexagon of ring connector 79 beneath recesses 82. As best shown in FIG. 17, the distal end 78 of each arm 77 is positioned flush within a respective cutout 90 when umbrella canopy 12 is maintained in a closed state.

Figure 18:
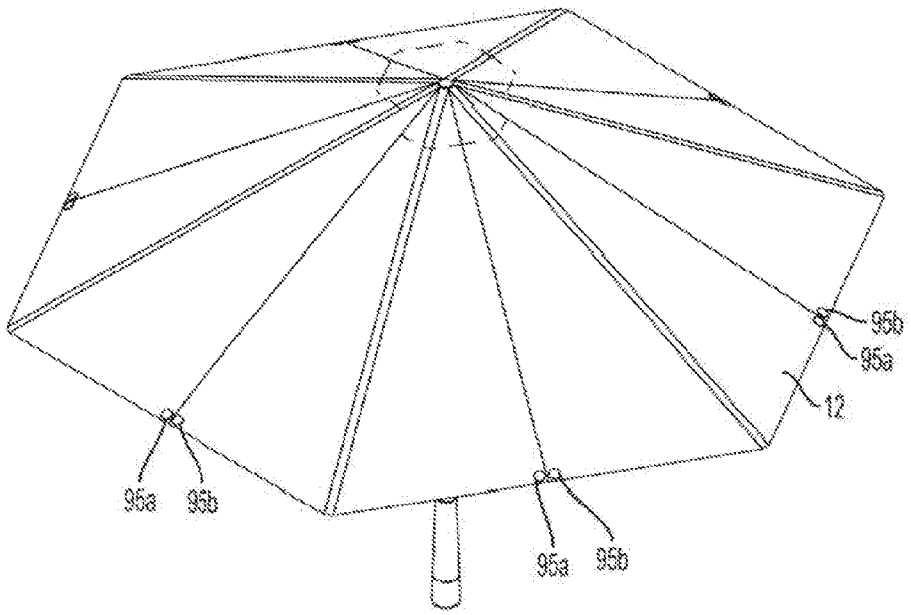
FIG. 18 depicts a perspective view of the canopy of the umbrella including a magnetic closure system.

FIG. 18 depicts a perspective view of canopy 12 including a magnetic closure system. In the magnetic closure system, adjacent panels of canopy 12 include magnets 95*a* and 95*b* having opposite polarity such that when canopy 12 nears its closed position, the adjacent magnets 95*a* and 95*b* will attract and connect with each other. The user then rolls the closed canopy causing the adjacent connected magnets to connect with each other thereby forming a tight and evenly rolled canopy to be stowed.

It should be understood that the number of magnets, as well as canopy panels, may vary from that which is shown and described, so long as the magnets are together capable of forming a magnetic loop closure system for stowing the canopy. For example, the canopy 12 may include six magnets 95 (one for every other panel) to achieve a similar effect. Alternatively, the canopy 12 may include as little as two magnets 95 to form a basic clasp. An umbrella canopy having 16 panels many include eight or sixteen magnets to create a loop. It should be understood that magnetic closure system is an optional feature of the umbrella.

Canopy 12 has a hexagonal shape and six rectangular arms 77 for moving the canopy between the open and closed positions. It is envisioned, however, that the shape of the canopy 12 may be that of an octagon, a decagon, or some other polygonal shape; and, the shape of the arms 77 may be triangular or any other polygonal shape rather than rectangular. Like an origami figure, the tension between the panels assists in opening and closing the canopy 12 of the umbrella 10 (as well as umbrella 200 described later).

Operation of the umbrella 10 from the fully-closed state of FIG. 1A to the late-closing state of FIG. 1F will now be described.

Starting from the fully-closed position of umbrella 10 shown in FIGS. 1A, 2, 3 and 17, canopy 12 is retracted in the fully-closed position and arms 70 and 77 are all positioned in the substantially vertical closed state shown in FIG. 17. Proximal end 17 of handgrip 11 is positioned within the interior of handle 20. Hook 28 of trigger assembly 16 is positioned within lower aperture 52 of outer rod 37 thereby locking umbrella 10 in the closed state. Spring 56 is maintained in a compressed position between the proximal end of outer rod 37 and the lower interior surface of handgrip 11. Hook 60 is positioned at the top distal end of elongated slot 34 of inner rod 33. Hook 60 is also positioned through aperture 46 of central rod 35. Ramp 27 is spaced apart from trigger 25 of trigger assembly 16 such that the surface of ramp 27 does not contact trigger 25.

Figure 5:
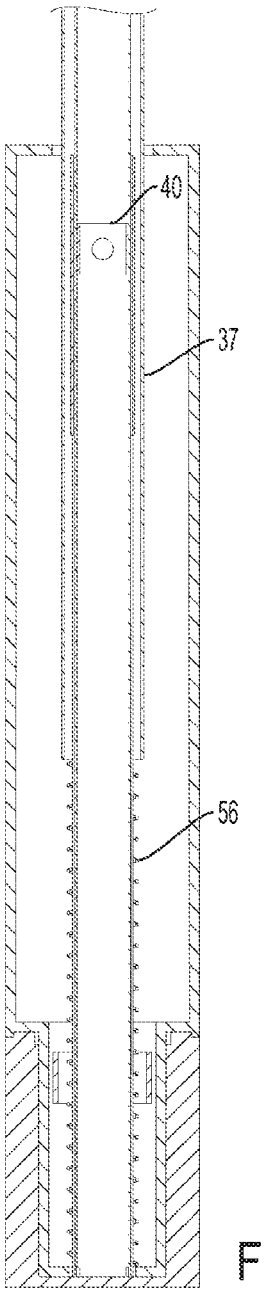

Turning now to FIGS. 1B, 4, 5 and 16, a user rotates handle 20 in a clockwise direction relative to handgrip 11 (see arrow in FIG. 1B), which causes the enlarged inner diameter 31 of handle ramp 27 to bear on trigger 25 of trigger assembly 16, as shown in FIGS. 4 and 5. Ramp 27 urges trigger 25 inwardly, which causes ring 22 to move to the right (as viewed in FIG. 4) against the force of spring 30. Hook 28 translates to the right along with ring 22, thereby causing landing surface 28' of hook 28 to separate from aperture 52 of outer rod 37. Once landing surface 28' separates from aperture 52 of outer rod 37, outer rod 37 is no longer fixed in position, and the stored energy of spring 56 translates outer rod 37 in an upward direction (compare FIGS. 2 and 4). As outer rod 37 translates upwardly, the inner surface of rod 37 slides along the tip of hook 60 while hook 60 remains stationary. Outer rod 37 translates over the stationary inner rod 33.

As shown in FIG. 16, as outer rod 37 translates upwardly, ring connector 68 of arm assembly 50 also translates upwardly, which causes arms 70 to pivot outwardly due to the hinged connection between ring connector 68 and arms 70. As arms 70 pivot outwardly, the arms 77 of canopy arm assembly 66 also pivot outwardly due to the hinged connection between arms 77 and arms 70 as well as the hinged connection between arms 77 and ring connector 79 of canopy arm assembly 66. As arms 77 pivot outwardly, canopy 12 moves toward the open and expanded state, as shown in FIG. 1B.

Figure 1C:
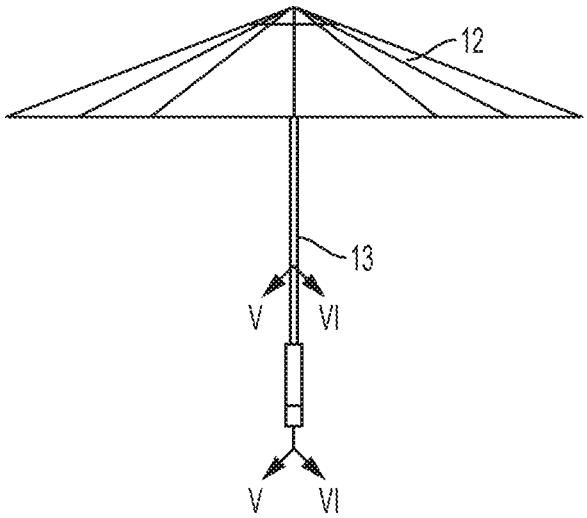
FIG. 1C depicts an elevation view of the umbrella of FIG. 1A shown in a fully-open state.
Figure 2A:
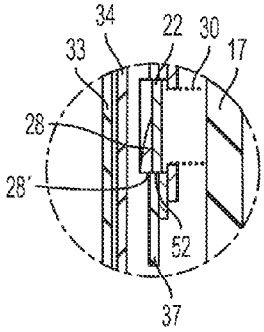
FIG. 2A is a detailed view of FIG. 2.

Once outer rod 37 detaches from the lower spring-loaded trigger assembly 25 and begins its upward ascent, handle 20 returns to the starting position shown in FIGS. 1C and 1A. As noted above, umbrella 10 may include a torsion spring (not shown) that is configured to automatically rotate handle 20 in a counter-clockwise direction, or, alternatively, the user may manually rotate handle 20 in a counter-clockwise direction to return it to the starting position. As also noted above, in an alternative embodiment, handle 20 does not rotate at all, and trigger 25 protrudes from the exterior surface of handle 20. In such an alternative embodiment, the user can manually depress the trigger to deploy the umbrella from the closed state to the open state.

Turning now to FIGS. 1C, 6, 7 and 15, as outer rod 37 continues to translate upwardly, arms 70 and 77 continue to pivot outwardly. Outer rod 37 continues to translate upwardly until spring loaded hook 60 engages with upper aperture 54 of outer rod 37. More particularly, once the end of hook 60 engages aperture 54, spring 62 of hook assembly 41 pushes hook 60 outwardly such that hook 60 springs into aperture 54. Hook assembly 41 cannot move upwardly along with outer rod 37 (by virtue of the force of spring 56) because hook 60 of hook assembly 41 is also engaged with stationary inner rod 33 and central rod 35. Thus, outer rod 37 is now locked in the fully-open state shown in FIGS. 1C, 6, 7 and 15. In the fully-open state of umbrella 10, canopy 12 is completely expanded, as best shown in FIGS. 1C and 15.

Figure 1D:
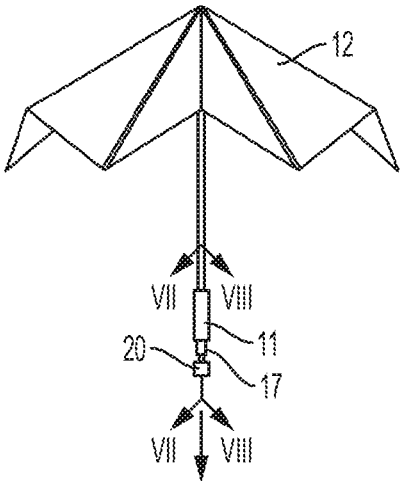
FIG. 1D depicts an elevation view of the umbrella of FIG. 1A shown in an early-closing state.

Turning now to FIGS. 1D, 8, 9 and 16, once the user desires to close umbrella 10, the user translates handle 20 in downward vertical direction (as indicated by the downward arrow in FIG. 1D). It is noted that the user could rotate handle 20 in a counter-clockwise direction while translating handle 20 downward assuming that (i) the user has not already rotated handle 20 in a counter-clockwise direction, and (ii) umbrella 10 does not include the torsion spring (not shown) that was described above for automatically rotating handle 20 in a counter-clockwise direction.

As handle 20 translates in a downward direction, central rod 35 translates downwardly along with handle 20 due to the connection between rod 35 and handle 20. Because hook 60 of hook assembly 40 is locked in aperture 46 of central rod 35, hook assembly 40 translates downward along with handle 20 and central rod 35. Because hook 60 of hook assembly 40 is also locked in aperture 54 of outer rod 37, outer rod 37 also translates downwardly against the force of spring 56 along with hook assembly 40, central rod 35 and handle 20. Spring 56 becomes compressed by outer rod 37 as it moves downwardly. Hook 60 freely travels along elongated slot 34 formed in stationary inner rod 33 as hook 60 translates downwardly along with outer rod 37.

As outer rod 37 translates downwardly, canopy 12 moves from the open position of FIG. 1C to the partially closed position of FIG. 1D. More particularly, as outer rod 37 translates downwardly, ring connector 68 of arm assembly 50 also translates downwardly, which causes arms 70 to pivot inwardly due to the hinged connection between ring connector 68 and arms 70. As arms 70 pivot inwardly, the arms 77 of canopy arm assembly 66 also pivot inwardly due to the hinged connection between arms 77 and arms 70 as well as the hinged connection between arms 77 and ring connector 79 of canopy arm assembly 66. Arm assemblies 50 and 66 eventually reach the partially-closed/open state shown in FIG. 16. Also, as arms 77 pivot inwardly to the position shown in FIG. 16, canopy 12 is drawn toward the partially-closed/open state shown in FIG. 1D.

Turning now to FIGS. 1E, 10, 11 and 17, the user continues to translate handle 20 in the downward direction along with outer rod 37, hook assembly 40 and central rod 35 until hook 28 of spring-loaded trigger assembly 16 springs into lower aperture 52 of outer rod 37 by virtue of the spring force of spring 30. Engagement between hook 28 and aperture 52 prevents handle 20 from moving further downward. At this stage of the closing process, canopy 12 reaches the fully-closed position shown in FIG. 1E, and arm assemblies 50 and 66 reach the fully-closed position shown in FIG. 17. If canopy 12 includes the magnetic closure system of FIG. 18, the adjacent magnets 95*a* and 95*b* will attract causing canopy 12 to take a tight and evenly rolled form.

Figure 1E:
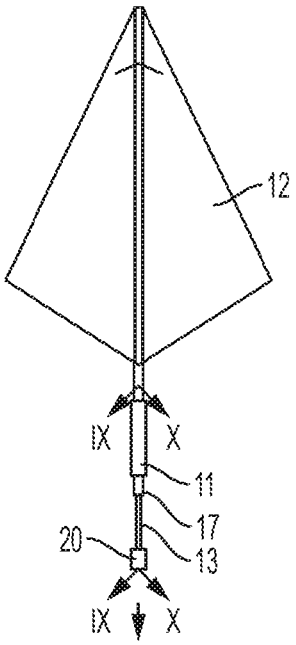
FIG. 1E depicts an elevation view of the umbrella of FIG. 1A shown in a mid-closing state.
Figure 1F:
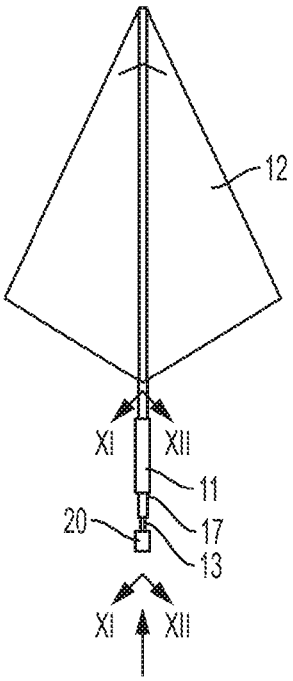
FIG. 1F depicts an elevation view of the umbrella of FIG. 1A shown in a late-closing state.
Figure 12:
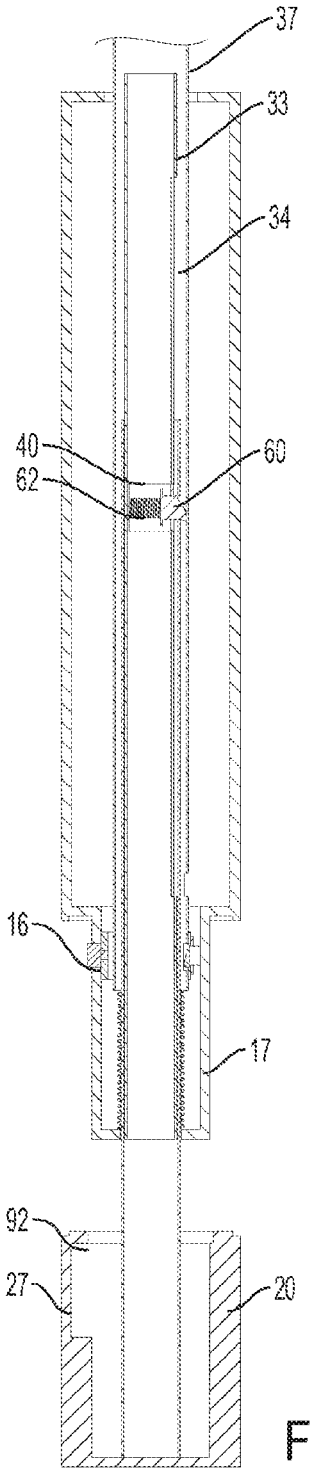
FIGS. 12 and 13 are cross-sectional views of the umbrella of FIG. 1F taken along the lines XI-XI and XII-XII, respectively.
Figure 13:
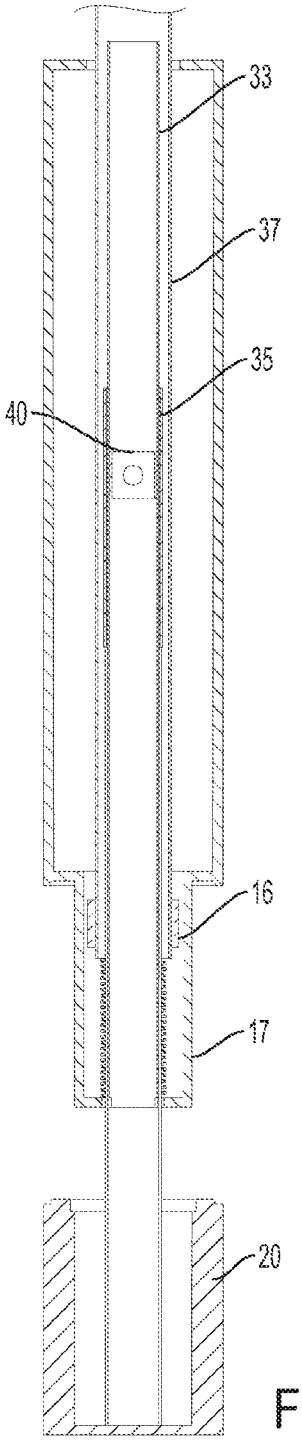

Turning now to FIGS. 1F, 12 and 13, at this point in the closing process, the canopy 12 is maintained in a fully-closed state while handle 20 remains in an extended state relative to handgrip 11 (as shown in FIG. 1E). The user then translates handle 20 in an upward direction (as indicated by the vertical arrow in FIG. 1F) in order mate handle 20 with the proximal portion 17 of handgrip 11. More particularly, central rod 35 and hook assembly 40 move in an upward direction as the user translates handle 20 in the upward direction. As hook assembly 40 moves upwardly along with handle 20, the curved surface of hook 60 bears against the upper edge of upper aperture 54 of outer rod 37, which ultimately causes hook 60 to translate inwardly against the bias of spring 62 until hook 60 disengages entirely from upper aperture 54 of outer rod 37. Outer rod 37 remains stationary as handle 20 is translated upwardly due to the engagement between hook 28 and lower aperture 52 of outer rod 37. As handle 20 is translated further upward the edge of hook 60 travels along the interior surface of outer rod 37. Hook 60 freely translates upwardly through elongated slot 34 of stationary inner rod 33 as hook 60 is moved upwardly.

Turning now to FIGS. 1A, 1F, 2 and 12, as handle 20 is moved further upwardly, handle 20 moves over proximal portion 17 of handgrip 11. As this happens, trigger 25 of trigger assembly 16 freely translates into the interior of handle 20 without contacting any surfaces of handle 20, such as ramp 27, which could inadvertently deploy trigger 25. This may be accomplished through dimensioning of the parts, or, alternatively, the top surface of handle 20 could include a radially and axially-extending channel 92 (partially shown in FIG. 12) through which trigger 25 passes as handle 20 moves over proximal portion 17 of handgrip 11. In other words, trigger 25 is not contacted by handle 20 until handle 20 is purposefully rotated (as described with reference to FIGS. 1B and 4) such that ramp 27 is positioned to positively contact the end of trigger 25.

Handle 20 is continued to be moved upwardly until the proximal portion 17 of handgrip 11 is seated in the interior of handle 20, as shown in FIG. 1A. At the same time, hook 60 bears on the top end of elongated slot 34 of stationary inner rod 33 such that handle 20 can no longer be translated upwardly relative to handgrip 11. Umbrella 10 is now returned to the fully-closed position shown in FIGS. 1A, 2 and 3.

Figure 19:
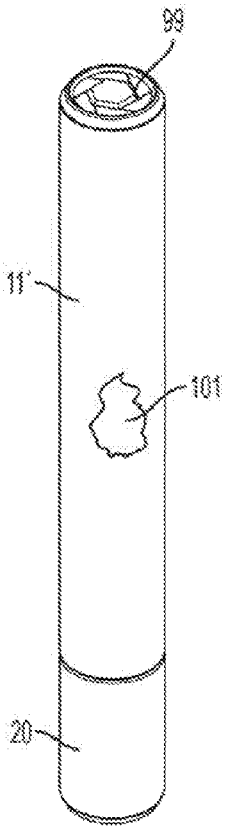
FIG. 19 depicts a perspective view of a handgrip for a compact model of the umbrella.

FIG. 19 depicts an alternative version of handgrip 11' for use with a compact version of the umbrella. The compact version of the umbrella shares the same structure and operation as umbrella 10 with at least the following exceptions: (i) the canopy of the compact umbrella contains more panels, which may be layered, to enhance foldability, (ii) the canopy is capable of translating downward with respect to handgrip 11', and (iii) handgrip 11' is sized to accommodate and conceal the entire length of the closed canopy so that the closed canopy is not visible to the user. Inner rod 33 of the compact umbrella would be configured to translate downward as canopy 12 is moved to the closed position (unlike umbrella 10) so that closed canopy could move downward into handgrip 11'.

The distal top end of handgrip 11' includes a seal 99 that substantially covers the aperture at the top end of handgrip 11.' Seal 99 is provided to either limit or prevent any trapped water on the canopy from escaping handgrip 11' after the canopy is stowed. The seal 99 may be configured to open and close like an adjustable aperture of a camera lens, such as that disclosed in U.S. Pat. No. 3,618,499, which is incorporated by reference in its entirety. Also, the seal 99 may be linked with movements of the handgrip 11' or the rod assembly. Also, the magnetic closure system may be utilized with the compact version of the umbrella so that the evenly rolled and closed canopy can fit within the interior region 111 of handgrip 11'.

FIGS. 20A-20F depict views of an umbrella 200, according to another example of the invention, shown moving between closed, open and late closing stages. The exterior of the umbrella 200 is substantially similar to that of umbrella 10, and the umbrellas share many of the same components, such as hinged arm assembly 50, canopy arm assembly 66 and canopy 12. The primary distinctions between umbrellas 10 and 200 are found in the handle, handgrip, rods and hooks, and those distinctions will be described hereinafter.

Umbrella 200 generally includes a stationary handgrip 211 and a handle 220 that are interconnected by a rod assembly 213. Rod assembly 213 includes mechanisms for deploying and retracting canopy 12 between the opened and closed states, like rod assembly 13 of umbrella 10.

Figure 20A:
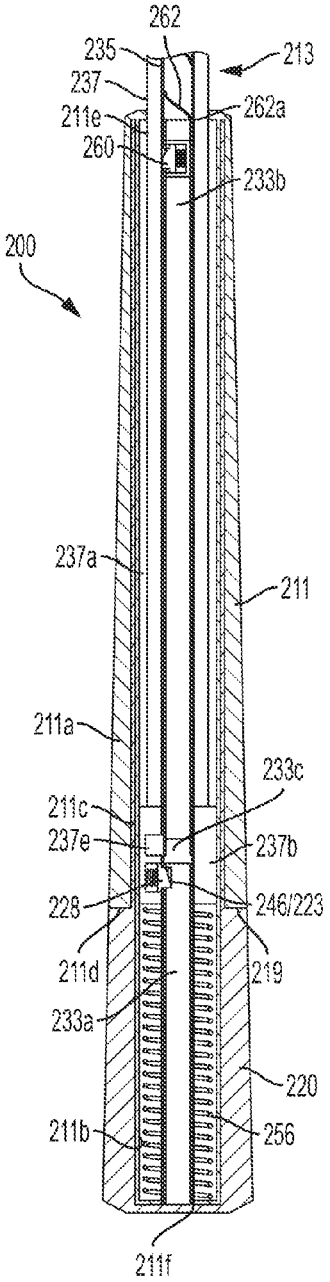
FIG. 20A depicts a partial cross-sectional view of another umbrella shown in a fully-closed state, according to another example of the invention.
Figure 20B:
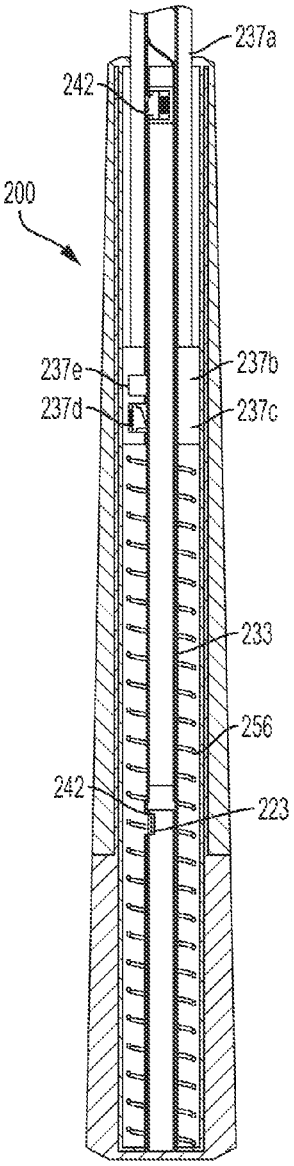
FIG. 20B depicts a partial cross-sectional view of the umbrella of FIG. 20A shown in a mid-opened state.
Figure 20C:
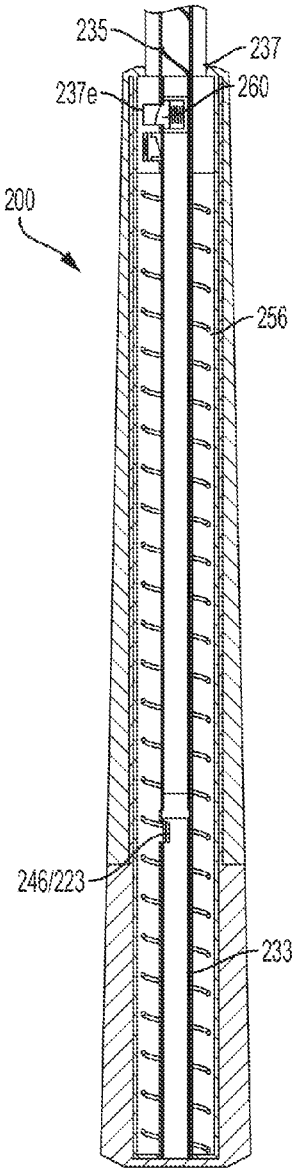
FIG. 20C depicts a partial cross-sectional view of the umbrella of FIG. 20A shown in a fully-open state.
Figure 20D:
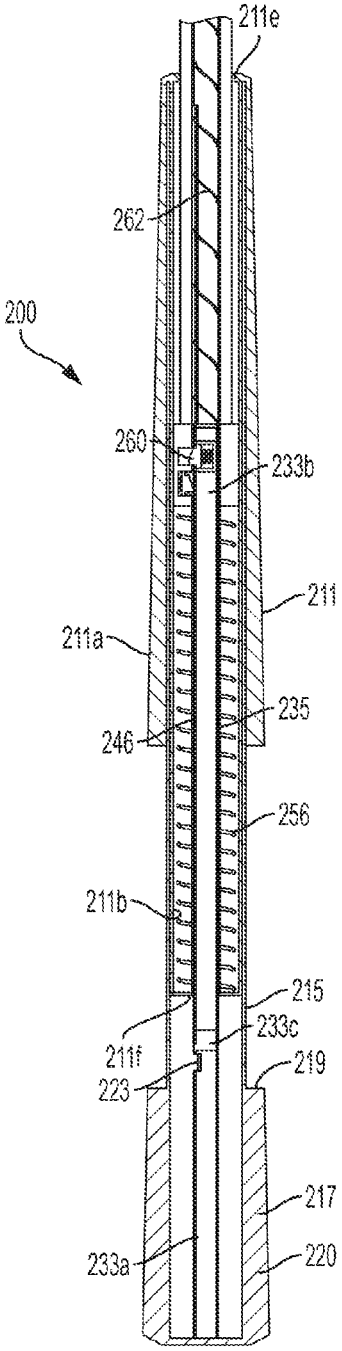
FIG. 20D depicts a partial cross-sectional view of the umbrella of FIG. 20A shown in an early-closing state.

Referring now to FIGS. 20A and 20D, handgrip 211 includes an exterior tube 211*a*, an interior tube 211*b* that is positioned radially inside of tube 211*a*, and an annular space 211*c* defined between the tubes 211*a* and 211*b*. Exterior tube 211*a* includes a frusto-conically shaped outer surface that is intended to be grasped by a user of umbrella 200. A shoulder 211*d* is defined at the proximal end of exterior tube 211*a* for seating against handle 220, and an opening 211*e* is defined at the distal end of tube 211*a* through which one or more rods of rod assembly 213 pass. Interior tube 211*b* also includes a frusto-conically shaped outer surface that is intended to be grasped by a user of umbrella 200. Interior tube 211*b* extends proximally of exterior tube 211*a* and terminates at a closed proximal end in which an opening 211*f* is defined.

Handle 220 is an elongated tube having an open distal end, a closed proximal end to which the rod assembly 213 is fixedly mounted, a large diameter proximal portion 217, a small diameter distal portion 215, and a shoulder 219 that is defined at the intersection of portions 215 and 217.

In the assembled form of the handle 220 and handgrip 211, the distal portion 215 of the handle 220 slides over the interior tube 211*b* of the handgrip 211 and within annular space 211*c* of handgrip 211. The handle 220 and handgrip 211 are interconnected by telescoping rod assembly 213.

Telescoping rod assembly 213 generally includes three telescoping hollow rods, i.e., an inner rod assembly 233, a central rod 235 surrounding inner rod 233, and an outer rod assembly 237 surrounding central rod 235.

Inner rod assembly 233 includes a lower rod portion 233*a* that is fixedly connected to the proximal base end of handle 220; an upper rod portion 233*b* mounted distally of lower rod portion 233*a*; a tension spring 262 having a proximal end that is fixed to the distal end of the upper rod portion 233*b*; and, a spring-loaded hook 260 (like hook 60) that extends radially outward from the distal end of the upper rod portion 233*b*.

Rod portions 233*a* and 223*b* are rotatably connected at rotatable connection 233*c* such that lower rod portion 233*a* can rotate with respect to upper rod portion 233*b* while rod portions 233*a* and 233*b* translate together. Lower rod portion 233*a* includes a cam surface 223 at its distal end which interacts with a spring loaded hook 228, the purpose of which will be described later. The cam surface 223 is a ramped surface that extends radially from the outer diameter of the rod portion 233*a* to a location that is radially inward of the outer diameter (like ramp surface 27, with one exception that cam surface 223 is disposed on an outer diameter). Lower rod portion 233*a* may or may not be directly integrated with handle 220. The distal end of upper rod portion 233*b* includes spring-loaded hook 260, which is structurally and functionally equivalent to hook 60. Alternatively, hook 260 (as well as hook 60) may be elastically deformable without being spring-loaded.

Tension spring 262 includes a proximal end 262*a* that is fixed to the distal end of the upper rod portion 233*b*. Spring 262 further includes a distal end that is fixed to the distal end of the central rod 235, the ring connector 79 or an end cap of the umbrella that is fixedly positioned at or near the ring connector 79. Spring 262 functions to automatically return handle 220 to its retracted position shown in FIG. 20A after it has been extended downward by a user (see FIG. 20E).

Central rod 235, which surrounds inner rod 233, includes a proximal end that is fixedly connected to the opening 211*f* at the proximal end of handgrip 211. The top distal end of central rod 235 is fixedly connected to the ring connector 79 of canopy arm assembly 66. The connection may be either direct or indirect. Central rod 235 includes one elongated slot 242 (the ends of the slot 242 are best shown in FIG. 20B) on its sidewall along which hook 260 travels as umbrella 200 moves between the closed and open positions.

Central rod 235 also includes an aperture 246 on its sidewall, which is both radially aligned with and positioned proximal of slot 242, for interacting with spring-loaded hook 228. Aperture 246 is also axially and radially aligned with cam surface 223 in the closed position of umbrella 200 shown in FIG. 20A. Aperture 246 permits hook 228 to interact with cam surface 223 in the closed position shown in FIG. 20A because central rod 235 surrounds inner rod 233. In other words, in the absence of aperture 246, central rod 235 would cover cam surface 223 and prevent hook 228 from interacting with cam surface 223. Central rod 235 is stationary, along with handgrip 211, as umbrella 200 moves between its open and closed positions.

Outer rod assembly 237 generally includes a hollow rod 237*a* that is positioned to surround central rod 235; a ring assembly 237*b* fixedly mounted to the proximal end of hollow rod 237; and a spring 256 positioned proximal of ring assembly 237*b*.

Hollow rod 237*a* includes a proximal end that is fixedly mounted to the distal end of ring assembly 237*b*, and a distal end that is fixedly mounted to hinged arm assembly 50 (see FIG. 15). Movement of hollow rod 237*a* causes the canopy 12 to open and close, which will be described in greater detail later.

Ring assembly 237*b* includes an annular ring 237*c* having a recess 237*d* formed in the interior sidewall of the annular ring 237*c* for accommodating spring-loaded hook 228. Another recess 237*e* is also formed in the interior sidewall of the annular ring directly above recess 237*d*. As will be described with reference to the operation of umbrella 200, hook 260 interacts with recess 237*e* to control translation of outer rod 237*a*.

Spring 256 is a compression spring that may or may not be fixedly connected to the proximal end of the annular ring 237*c*.

Operation of the umbrella 200 from the fully-closed state of FIG. 20A to the late-closing state of FIG. 20F will now be described.

Starting from the fully-closed position of umbrella 200 shown in FIGS. 20A and 17, canopy 12 is retracted in the fully-closed position and arms 70 and 77 are all positioned in the substantially vertical closed state shown in FIG. 17. Hook 228 is positioned within opening 246 and engaged with the small outer diameter of cam 223 thereby locking umbrella 200 in the closed state. Spring 256 is maintained in a compressed state between the proximal end of handgrip 211 and the proximal end of ring assembly 237*b*. It should be understood that the closed umbrella 200 is substantially equivalent to the closed umbrella 10 of FIG. 1A.

Turning now to FIGS. 20B and 16, a user manually rotates handle 220 in a clockwise direction relative to handgrip 211, which causes the large outer diameter of cam surface 223 to bear on the end of hook 228. The cam 223 consequently urges hook 228 outwardly, which causes the distal end (i.e., upper end) of hook 228 to withdrawal from opening 246. At this point, outer rod assembly 237 is no longer fixed in position by hook 228, and the stored energy of spring 256 translates outer rod assembly 237 in a distal upward direction (compare FIGS. 20A and 20B). As outer rod assembly 237 translates upwardly, it translates over the stationary inner rod 233 and the stationary central rod 235.

As shown in FIG. 16, as outer rod assembly 237 translates upwardly, ring connector 68 of arm assembly 50 also translates upwardly, which causes arms 70 to pivot outwardly due to the hinged connection between ring connector 68 and arms 70. As arms 70 pivot outwardly, the arms 77 of canopy arm assembly 66 also pivot outwardly due to the hinged connection between arms 77 and arms 70 as well as the hinged connection between arms 77 and ring connector 79 of canopy arm assembly 66. As arms 77 pivot outwardly, canopy 12 moves toward the open and expanded state, as shown in FIG. 1B.

Once outer rod assembly 237 begins its upward descent, handle 220 returns to the starting position shown in FIG. 20A (like handle 20). Like umbrella 10, umbrella 200 may include a torsion spring (not shown) that is configured to automatically rotate handle 220 in a counter-clockwise direction, or, alternatively, the user may manually rotate handle 220 in a counter-clockwise direction to return it to the starting position after the umbrella has opened.

Turning now to FIG. 20C, as outer rod assembly 237 continues to translate upwardly, arms 70 and 77 continue to pivot outwardly. Outer rod assembly 237 continues to translate upwardly until spring loaded hook 260 springs into and positively engages recess 237*e* of outer rod assembly 237. More particularly, once the end of hook 260 aligns with recess 237*e*, the spring of hook 260 pushes hook 260 outwardly such that hook 260 springs into recess 237*e*. Hook 260 cannot move further upward along with outer rod assembly 237 (by virtue of the force of spring 256) because hook 260 is also engaged with stationary inner rod 233. Thus, outer rod assembly 237 is now locked in the fully-open state. In the fully-open state of umbrella 200, canopy 12 is completely expanded, as best shown in FIGS. 1C and 15. It should be understood that the open umbrella 200 is substantially equivalent to the open umbrella 10 of FIG. 1C.

Turning now to FIG. 20D, once the user desires to close umbrella 200, the user translates handle 220 in downward vertical direction. Handgrip 211 remains stationary. As handle 220 translates in a downward direction, inner rod assembly 233 translates downwardly along with handle 220 due to the connection between rod 233*a* and handle 220. As inner rod assembly 233 translates downwardly, tension spring 262 expands and reaches a tensioned state. Because hook 260 is also locked in aperture 237*e* of outer rod assembly 237, outer rod assembly 237 also translates downwardly against the force of compression spring 256 along with hook 260, inner rod assembly 233 and handle 220. Hook 260 freely travels along elongated slot 234 formed in central rod 235 as hook 260 translates downwardly along with outer rod assembly 237.

As outer rod assembly 237 translates downwardly, canopy 12 moves from the open position of FIG. 1C to the partially closed position of FIG. 1D. More particularly, the distal end of outer rod assembly 237 is connected to ring connector 68 of arm assembly 50. Thus, as outer rod assembly 237 translates downwardly, ring connector 68 of arm assembly 50 also translates downwardly, which causes arms 70 to pivot inwardly due to the hinged connection between ring connector 68 and arms 70. As arms 70 pivot inwardly, the arms 77 of canopy arm assembly 66 also pivot inwardly due to the hinged connection between arms 77 and arms 70 as well as the hinged connection between arms 77 and ring connector 79 of canopy arm assembly 66. Arm assemblies 50 and 66 eventually reach the partially-closed/open state shown in FIG. 16. Also, as arms 77 pivot inwardly to the position shown in FIG. 16, canopy 12 is drawn toward the partially-closed/open state shown in FIG. 1D.

Figure 20E:
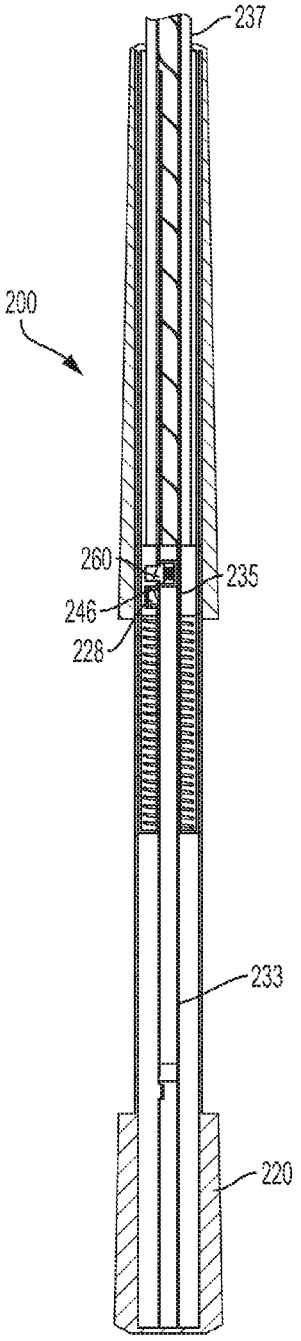
FIG. 20E depicts a partial cross-sectional view of the umbrella of FIG. 20A shown in a mid-closing state.

Turning now to FIG. 20E, the user continues to translate handle 220 in the downward direction along with outer rod assembly 237 and inner rod assembly 233 (by virtue of the engagement between hook 228 and recess 237*e*) until hook 228 springs into opening 246 of central rod 235. Engagement between hook 228 and aperture 246 locks the umbrella canopy 12 in the closed position, and also prevents handle 20 from moving further downward. Also, engagement between hook 228 and aperture 246 locks the outer rod assembly 237 to the central rod assembly 235. At this stage of the closing process, canopy 12 reaches the fully-closed position shown in FIG. 1E, and arm assemblies 50 and 66 reach the fully-closed position shown in FIG. 17.

Figure 20F:
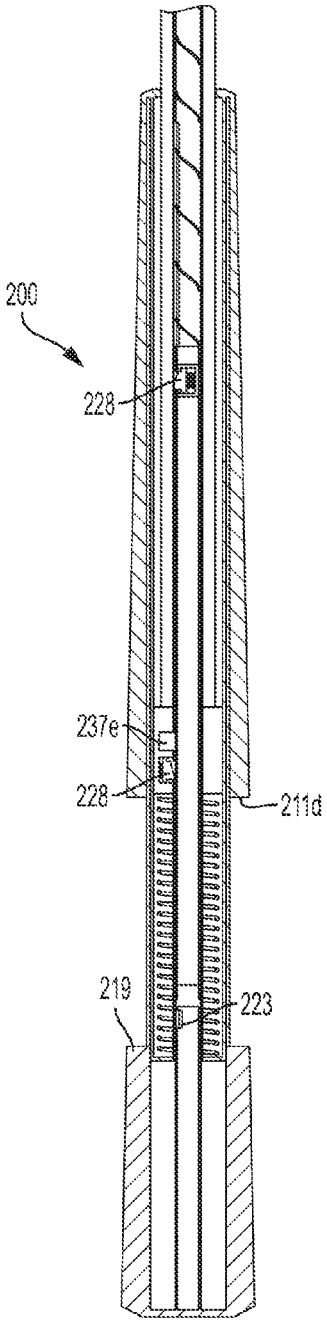
FIG. 20F depicts a partial cross-sectional view of the umbrella of FIG. 20A shown in a late-closing state.

Turning now to FIG. 20F, at this point in the closing process, the canopy 12 is maintained in a fully-closed state while handle 220 remains in an extended state relative to handgrip 211. The user then releases the handle 220. Upon releasing handle 220, tension spring 262, which is in a tensioned and extended state, pulls inner rod assembly 233 in an upward direction. As hook 260 of inner rod assembly 233 moves upwardly along with handle 220, the curved surface of hook 260 bears against the upper edge of aperture 237*e* of outer rod assembly 237, which ultimately causes hook 260 to translate inwardly against the bias of its spring until hook 260 disengages entirely from aperture 237*e*, and, eventually, outer rod assembly 237. Outer rod 237 remains stationary and locked to central rod 235, which is also stationary, as handle 220 is translated upwardly due to the engagement between hook 228 and aperture 246 of central rod 235. As handle 220 is translated further upwardly, the edge of hook 228 travels along the outer surface of inner rod assembly 233. Also, as the handle 220 moves upwardly, the distal portion 215 of the handle 220 slides over the interior tube 211*b* of the handgrip 211 and further into annular space 211*c* of handgrip 211.

Turning back to FIG. 20A, as handle 220 is moved further upwardly, the shoulder 211*d* of handgrip 211 eventually bears on shoulder 219 of handle 220. At the same time or shortly before those shoulders bear on each other, hook 228 springs through opening 246 to contact the small diameter portion of cam surface 223. Engagement between the hook 228, opening 246 and cam surface 223 serve to lock umbrella 200 in the closed position. Umbrella 200 is now returned to the fully-closed position shown in FIGS. 1A and 20A. To move umbrella 200 from the fully-closed position to the open position, it is necessary to rotate handle 220, as described above.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein.

It is intended by the following claims to claim any and all applications, modifications and variations that fall within the true scope of the present teachings.

What is claimed is:

1. An umbrella comprising:

a rod assembly including a plurality of rods;

a canopy connected to the rod assembly and movable between an open position in which the canopy is deployed and a closed position in which the canopy is retracted;

a stationary handgrip for grasping the umbrella, the handgrip being connected to said rod assembly;

a ring assembly that is releasably connected to at least one rod of the rod assembly, wherein, upon actuation of a hook of the ring assembly, the hook releases said at least one rod which causes the canopy to move from the closed position to the open position; and a handle movable with respect to said handgrip and connected to said rod assembly, the handle being translatable from a retracted position to an extended position to move the canopy from the open position to the closed position; and a compression spring that is positioned to deploy said at least one rod of the rod assembly, which moves the canopy from the closed position to the open position upon activation of the trigger assembly.

2. The umbrella of claim 1, wherein, in an unactuated position of the ring assembly, the rod assembly is held in a retracted position by the ring assembly.

3. The umbrella of claim 2, wherein the ring assembly includes (i) a ring at least partially surrounding the rod assembly, and (ii) a hook extending from the ring and positioned to selectively engage the rod assembly.

4. The umbrella of claim 3, wherein upon rotation of the handle, the hook separates from said at least one rod of the rod assembly, the compression spring translates the rod assembly, and the canopy moves from the closed position to the open position.

5. The umbrella of claim 4, wherein said at least one rod of the rod assembly includes either a cam surface or an aperture for receiving the hook of the ring assembly in the closed position of the canopy.

6. The umbrella of claim 5, wherein the ring assembly further comprises a spring for biasing the hook toward said cam surface or said aperture of the said at least one rod of the rod assembly, and said at least one rod of the rod assembly is connected to said handle.

7. The umbrella of claim 2, wherein the rod assembly includes two apertures, wherein one of the apertures of the at least two apertures receives the hook of the ring assembly in a closed position of the canopy and the other aperture of the at least two apertures receives a spring-loaded hook assembly in an open position of the canopy.

8. The umbrella of claim 1 further comprising a tension spring that is positioned to move the handle from the extended position back to the retracted position after the canopy is closed.

9. The umbrella of claim 1 further comprising a spring-loaded hook assembly contained within the rod assembly for maintaining the canopy in the open position.

10. The umbrella of claim 9, wherein the spring-loaded hook assembly comprises a ring that is positioned within the rod assembly, and a spring-loaded hook that is mounted to the ring.

11. An umbrella comprising:

a rod assembly including a plurality of rods;

a canopy connected to the rod assembly and movable between an open position in which the canopy is deployed and a closed position in which the canopy is retracted;

a stationary handgrip for grasping the umbrella, the handgrip being connected to said rod assembly;

a ring assembly that is releasably connected to at least one rod of the rod assembly, wherein, upon actuation of a hook of the ring assembly, the hook releases said at least one rod which causes the canopy to move from the closed position to the open position; and a handle movable with respect to said handgrip and connected to said rod assembly, the handle being translatable from a retracted position to an extended position to move the canopy from the open position to the closed position, wherein the ring assembly is translatable in a vertical direction with respect to at least one rod of the rod assembly as the canopy moves from the open position to the closed position.

12. The umbrella of claim 1, wherein the canopy includes a plurality of magnets to retain the canopy in the closed position.

13. The umbrella of claim 1, wherein the rod assembly includes a first rod that is fixed with respect to the handle and a second rod that is movable with respect to the handle.

14. An umbrella comprising:

a rod assembly including a plurality of rods;

a canopy connected to the rod assembly and movable between an open position in which the canopy is deployed and a closed position in which the canopy is retracted;

a stationary handgrip for grasping the umbrella, said handgrip being connected to said rod assembly;

a compression spring that is located within the handgrip and is biased to deploy at least one rod of the rod assembly and move the canopy toward the open position;

a ring assembly that is releasably connected to said at least one rod of the rod assembly, wherein, upon actuation of a hook of the ring assembly, the hook releases said at least one rod of the rod assembly which deploys and causes the canopy to move from the closed position to the open position;

a handle movable with respect to said handgrip and connected to said rod assembly, the handle being translatable from a retracted position to an extended position to move the canopy from the open position to the closed position; and a tension spring that is positioned to move the handle from the extended position back to the retracted position after the canopy is closed.

15. The umbrella of claim 14, wherein the stationary handgrip includes an interior space.

16. The umbrella of claim 15, the stationary handgrip having an aperture at one end of the interior space, and a seal at least partially covering the aperture to either limit or prevent the escapement of water from the handgrip.

* * * * *